US006478298B1

(12) United States Patent
Mandel

(10) Patent No.: US 6,478,298 B1
(45) Date of Patent: Nov. 12, 2002

(54) FIXED STATION SORTER/MAILBOX WITH PASSIVE GATE STATION ENTRANCE SYSTEM

(75) Inventor: Barry Mandel, Fairport, NY (US)

(73) Assignee: Xerox Corporation, Stamford, CT (US)

( * ) Notice: Subject to any disclaimer, the term of this patent is extended or adjusted under 35 U.S.C. 154(b) by 84 days.

(21) Appl. No.: 09/632,275

(22) Filed: Aug. 3, 2000

(51) Int. Cl.[7] ..... B65H 39/10
(52) U.S. Cl. ..... 271/298; 271/303
(58) Field of Search ..... 271/298, 303, 271/291, 297, 288

(56) References Cited

U.S. PATENT DOCUMENTS 4,428,572 A * 1/1984 Burke ..... 271/197
5,957,450 A * 9/1999 Kida et al. ..... 271/298 X

* cited by examiner

*Primary Examiner*—Christopher P. Ellis
*Assistant Examiner*—Richard Ridley
(74) *Attorney, Agent, or Firm*—Perman & Green, LLP

(57) ABSTRACT

A sheet handling transport apparatus. The apparatus comprises a sheet transport mechanism adapted to move a sheet in a first direction along a path in the apparatus, and a plurality of sheet receiving stations in the apparatus. The apparatus includes a gate associated with each station. The transport mechanism is adapted to deliver the sheet into a selected station by reversing the direction of the sheet in the path when the sheet is at a point adjacent the gate corresponding to the selected station.

25 Claims, 10 Drawing Sheets

FIXED STATION SORTER/MAILBOX WITH PASSIVE GATE STATION ENTRANCE SYSTEM

BACKGROUND OF THE INVENTION

1. Field of the Invention

The present invention relates generally to sheet handling systems, and in particular to a system and method for directing sheets into specific sheet receiving stations without using active gates, moving the stations or moving/translating the entrance nip.

2. Prior Art

There are three primary paper-handling schemes used in sorters and Mailbox devices. One method is to use fixed stations and a series of gates that are actuated by a series of solenoids, or some other active means. Very often these systems have a separate solenoid for each gate. A second scheme uses fixed stations and a moving entrance nip to deliver the sheet to the appropriate station. In this type of system a "window shade" type system holds sheets to the belt. This type of system can cause problems with high static. Also, these systems often include an eject nip that is driven up and down with a separate drive system in order to deliver the sheet to the appropriate station. A third scheme uses moving stations that increment up and down past a fixed sheet ejection nip system. Generally, a mechanism is required to lift/move the entire station array as well as each separate station at the paper entrance for loading. All three of these schemes require a significant number of moving parts and control electronics. Furthermore, a moving station scheme is not very desirable for a Mailbox system since the stations are unloaded on an ongoing basis (not just at the end of a job like in a copier), and having moving stations can create operability and safety issues.

SUMMARY OF THE INVENTION

The present invention is directed to an improved sheet handling and transporting apparatus and method. In one embodiment of the invention, the apparatus comprises a sheet transport mechanism adapted to move a sheet in a first direction along a path in the apparatus, and a plurality of sheet receiving stations. The apparatus includes a gate associated with a each station. The transport mechanism is adapted to deliver the sheet into a selected station by reversing the direction of the sheet in the path when the sheet is at a point adjacent a gate corresponding to the selected station.

The present invention, in another embodiment, is directed to a method of directing a sheet into a sheet receiving station of a transport apparatus. The method comprises transporting the sheet in a first direction in the apparatus and stopping the sheet at a point adjacent a gate associated with the sheet receiving station. The sheet is then transported in a second direction and directed into the sheet receiving station through a gate.

In another aspect, the present invention, in another embodiment, is directed to a method of directing a sheet into one of a plurality of sheet receiving stations in a reversible drive transport apparatus. The method comprises detecting a presence of a sheet in a first transport path of the transport apparatus. The sheet is transported in a first direction along the first transport path for a predetermined time period after being detected that is associated with a selected sheet-receiving station. The direction of the sheet is reversed and the sheet is directed into a second transport path using a passive gate associated with the selected station and delivered into the selected station.

In a further embodiment, the present invention is directed to a method of directing a sheet into a bin of a sheet sorter apparatus. The method comprises receiving the sheet into the sheet sorter apparatus and determining if a time gap is required between the sheet and another sheet. The sheet is detected in a path of the apparatus and a sorter drive timing sequence is initiated. The timing sequence is adapted to stop a drive of the apparatus after a predetermined time associated with the bin. The drive of the sorter apparatus is then reversed to drive the sheet into the bin.

BRIEF DESCRIPTION OF THE DRAWINGS

The foregoing aspects and other features of the present invention are explained in the following description, taken in connection with the accompanying drawings, wherein.

DETAILED DESCRIPTION OF THE PREFERRED EMBODIMENT

Figure 1:
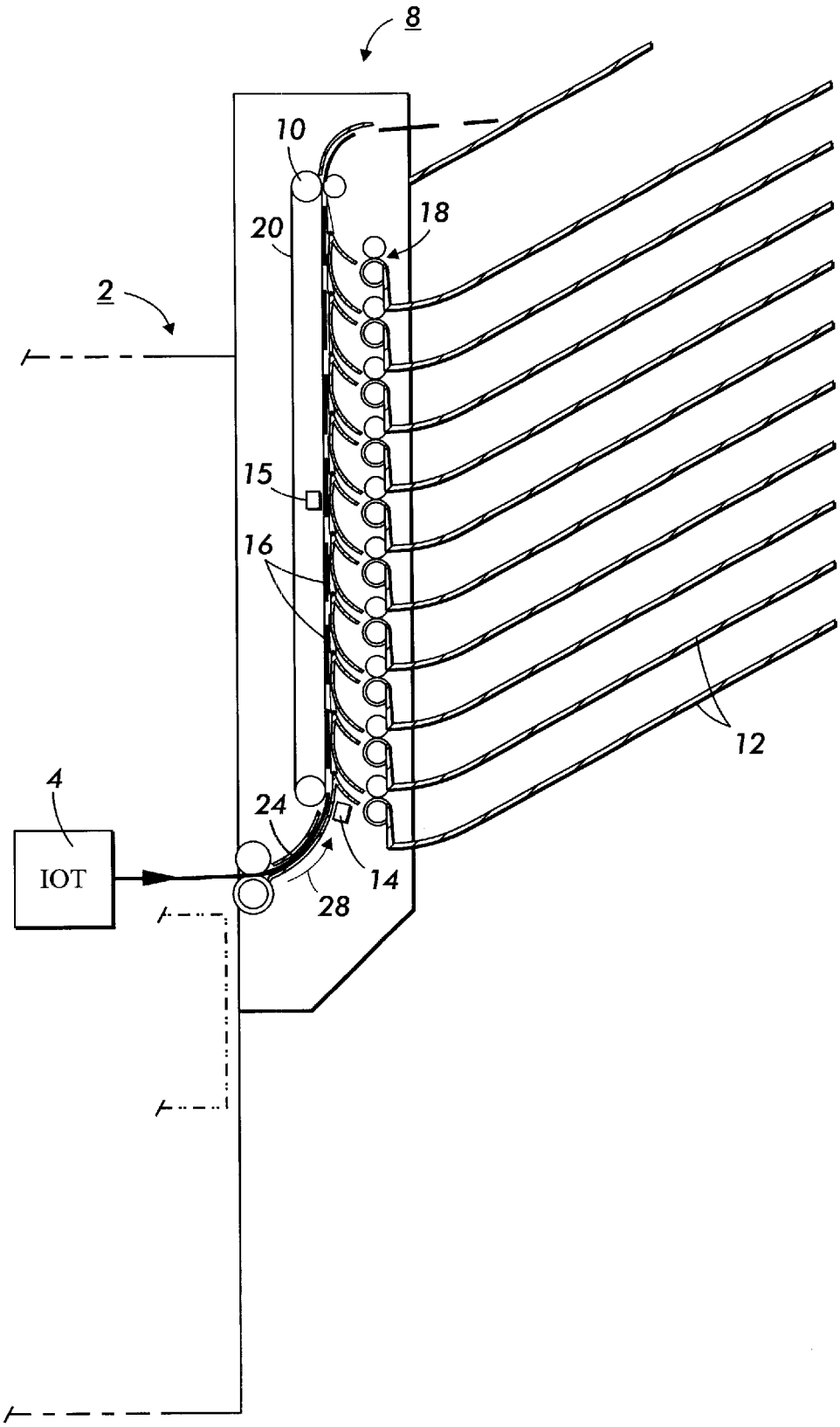
FIG. 1 is a perspective side view of a system incorporating features of the present invention.

Referring to FIG. 1, a perspective view of a sheet handling system 8 incorporating features of the present invention is shown. Although the present invention will be described with reference to the embodiments shown in the drawings, it should be understood that the present invention could be embodied in many alternate forms of embodiments. In addition, any suitable size, shape, configuration or type of elements or materials could be used.

The system 8 generally comprises a drive apparatus 10, one or more sheet receiving stations 12, and a gate 16 associated with each station 12. The sheet receiving station 12 may, for example, be a sorter at the output side of a copier, printer, etc. In one embodiment, the system 8 comprises a sheet sorter output device. In the preferred embodiment, the drive apparatus 10 comprises a reversible drive transport apparatus. In alternative embodiments, the system 8 can include additional items suitable for controlling the movement of a sheet 24 in a sheet handling system 8. It is a feature of this embodiment of the present invention to control the movement of a sheet 24 in a sheet handling system 8 using the drive apparatus 10 and without the use of active gates, without moving the stations and without moving or translating the entrance nips to the stations 12. The sheet receiving stations 12 cculd comprise a bin, a catch tray or other suitable sheet receiving mechanism. In one embodiment, the sheet receiving station 12 comprises a duplex-scanning loop.

The drive apparatus 10 generally comprises a reversible motor (not shown) coupled with a sheet transport device 20.

The motor can include any suitable mechanism adapted to drive the sheet transport device 20. In one embodiment, the motor comprises a reversible drive transport motor with variable stopping points. The sheet transport device 20 generally comprises a belt system adapted to hold a sheet 24 against the belt in order to transport the sheet 24 along the path 28 to its destination. Alternatively, the sheet transport device 20 can include any conventional sheet transport device for moving sheets along the path 28. It is a feature of the present invention to be able to stop and reverse the movement and direction of a sheet 24 in the path 28 along various points in the path 28.

The drive apparatus 10 can also include a controller (not shown) to control the motor and the movement of the sheet transport device 20. The controller is generally adapted to control the stopping and direction reversal of the sheet transport device. In one embodiment, the controller provides command signals to the motor to direct the movement of the sheet transport device. The controller may include electronics, software and other suitable components or devices to control the movement of the sheet transport device 20 based on a stop/reverse timing sequence or algorithm. The stop/reverse timing sequence may be a functional part of the controller or inputted from an external device or user. Generally, the stop/reverse timing sequence is based upon the detection of the sheet 24 and other predefined timing parameters. Alternatively, the drive apparatus 10 can include any suitable means for controlling the drive and direction of the motor and sheet transport device 20. It is a feature of the present invention to be able to stop and reverse the direction of the sheet transport device 20 at a point in the path 28 where the trailing edge of the sheet 24 is adjacent the position of a gate 16 corresponding to a station 12.

Figure 2:
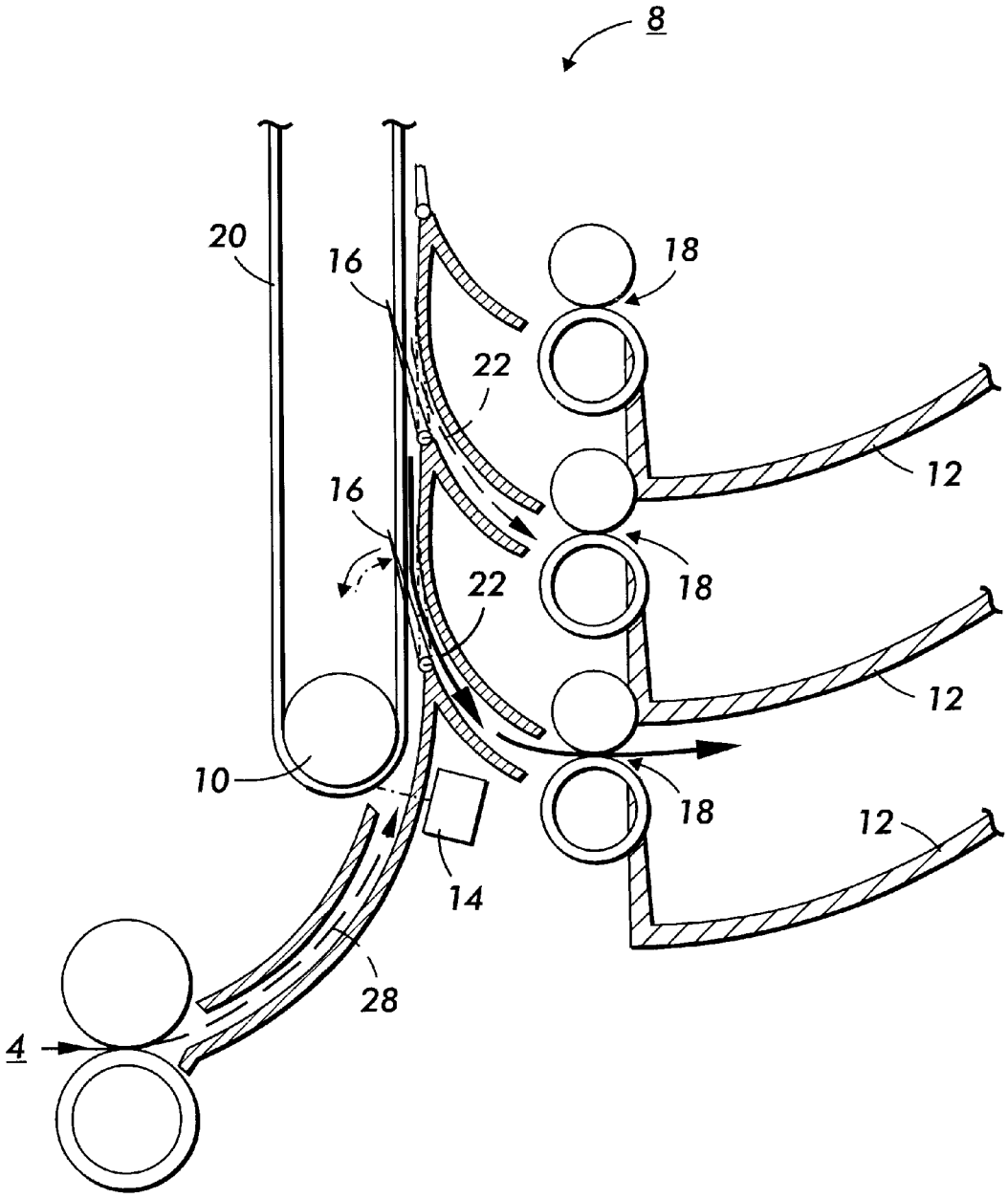
FIG. 2 is an exploded view of a portion of FIG. 1.

A gate 16 is generally associated with each station 12 in the system 8. The gate 16 is preferably a passive gate. A gate is "passive" in the sense that the gate is not controlled by active means, such as for example, a gate solenoid, as is the case with an "active" gate. In one embodiment, a passive gate can include movable components, such as a spring loaded or gravity loaded mechanism, that allows a sheet 24 to push or move the gate out of the way as it moves past the gate 16 in one direction. After the trailing edge of the sheet 24 travels past the gate to a point adjacent the gate 16 in the path, the gate 16 returns to its normal position so that the gate 16 can direct the sheet 24 as it moves into the gate 16 in another direction. Examples of these types of passive gates include lightly loaded pivoting plastic gates, spring or gravity loaded gates and mylar strip systems. In an alternate embodiment, the gate 16 can include any suitable gating means adapted to direct a sheet 24 into a station 12, including an active gate. It is a feature of the present invention to direct a sheet 24 in the path 28 into a station 12 without the use of an active gate. In one embodiment, the gate 16 can comprise mylar fingers or mylar strip system similar to those sometimes used in reversing roll inverters. As shown in FIG. 2, each gate 16 is generally located near or adjacent to an entrance path 22 for each station 12. Generally, the gate 16 is adapted to allow a sheet 24 traveling along the path 28 in a first direction to push the gate 16 out of the way as it first goes past. When the trailing edge of the sheet 24 passes the gate 16, the gate 16 returns to its normal position. Generally, the sheet 24 will be positioned at a point adjacent to the gate 16 so that when the sheet 24 reverses direction, the gate 16 directs the sheet 24 into the destination station 12. Alternatively, the gate 16 can be located in any suitable position in order to direct or divert a sheet 24 into a station 12 from the path 28 without moving the station or without moving/translating an entrance nip associated with the station. It is a feature of the present invention that when the direction of a sheet 24 is reversed at a point in the path 28 adjacent to or past a selected gate 16, the gate 16 directs the sheet 24 into the corresponding station 12.

The system 8 could also include one or more sensors 14 adapted to detect the presence of a sheet 24 in the path 28. The sensor 14 can include any suitable sensing or detection device, including an electronic, optical, mechanical or electromechanical sensing device. In one embodiment, the sensor 14 can be positioned to detect the presence of the sheet 24 as it enters the path 28 from a document handler device, such as for example, an image output terminal ("IOT") 4. Alternately, the sensor 14 could be located in any suitable position in order to detect a presence of the sheet 24 in the path 28. It is a feature of the present invention to control the movement of the sheet transport device 20 based upon the detection of the sheet 24. In one embodiment, as shown in FIG. 1, the system 8 can include a first sensor 14 located at a point along the path 28 where the sheet 24 enters the path 28 and a second sensor 15 located approximately half way up the path 28 in the sheet transport device 20. Alternately, the system 8 can include any suitable number of sensors 14 in various positions to enable the system 8 to detect the presence of the sheet 24 in one or more positions or points. It is a feature of the present invention to use the detection of the sheet 24 to initiate a timing sequence in order to control the movement of the sheet 24 in the path 28.

In one embodiment, the stop/reverse timing sequence of the drive apparatus 8 can be based upon the detection of a trailing edge of the sheet 24. In an alternate embodiment, the stop/reverse timing sequence can be based upon the detection of any suitable portion of the sheet 24. Generally, the detection of the sheet 24 initiates the stop/reverse timing sequence which can include certain predefined timing parameters associated with a selected destination station 12. The predefined timing parameters can include, for example, the speed of the motor, the length and size of the sheet 24, the position of each station 12, as well as the distance between and to each station 12 and the length of the station array. In an alternate embodiment, the timing parameters can include any suitable parameters used to define a position of sheet 24 relative to a selected destination station 12. The stop/reverse timing sequence generally controls the movement of the sheet 24 in one or more directions for a predetermined time period associated with the selected station 12.

The system 8 can also include one or more exit nips 18 associated with each station 12. Generally, the exit nip 18 can include any conventional exit nip device. The exit nips 18 are generally adapted to receive a sheet 24 driven into the gate entrance path 22 of the station 12. A positive force of the exit nip 18 generally pulls the sheet 24 and delivers the sheet 24 into the station 12. Alternatively, the system 8 can include any suitable means to deliver a sheet 24 into a station 12 other than an exit nip 18. Generally, the exit nips 18 are adapted to be stationary within the system 8. It is a feature of this embodiment of the present invention to deliver a sheet 24 into a station without moving or translating a position of the exit nips 18. In an alternate embodiment, the exit nips 18 could include active means adapted to move or translate the position of the exit nips 18.

Figure 3A:
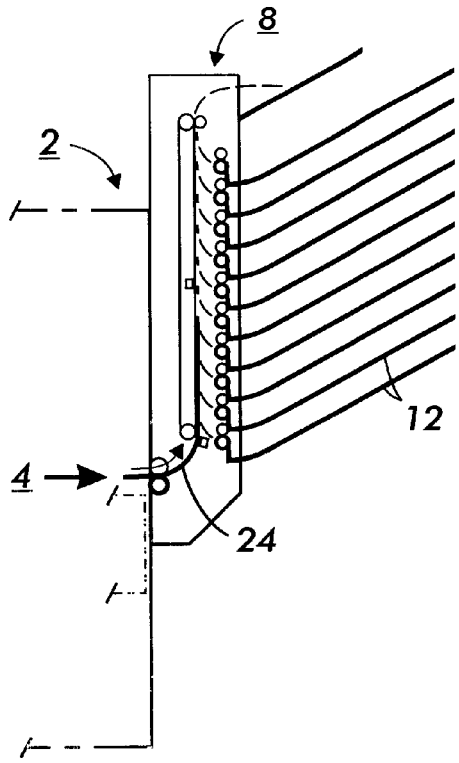
FIGS. 3A–3D are perspective views of an embodiment of the present invention depicting the movement of a sheet through the system.
Figure 3B:
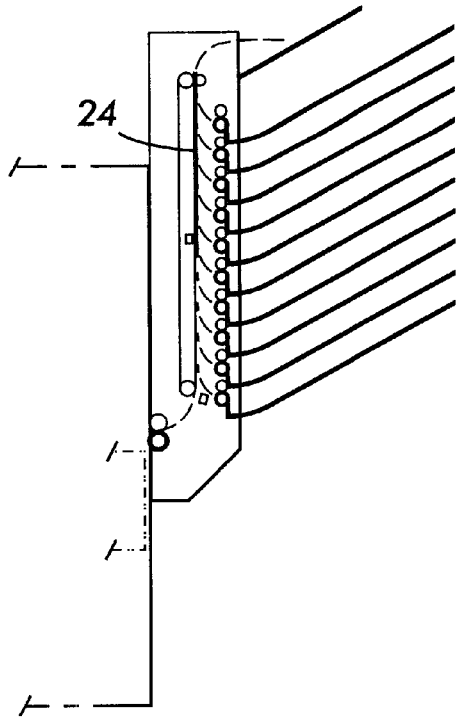
Figure 3C:
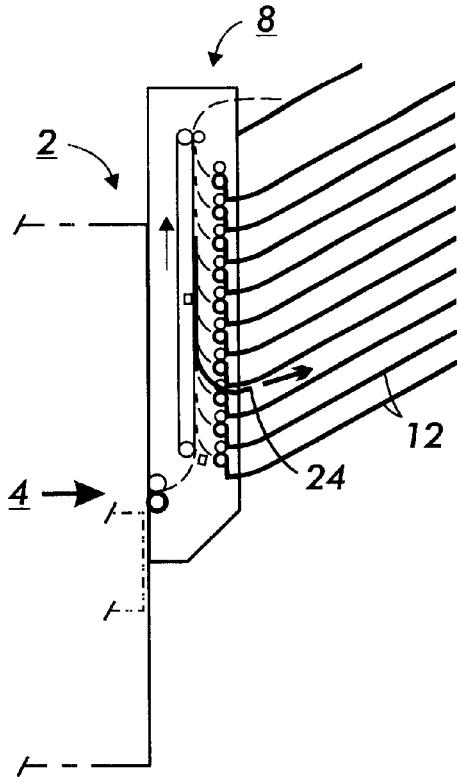
Figure 3D:
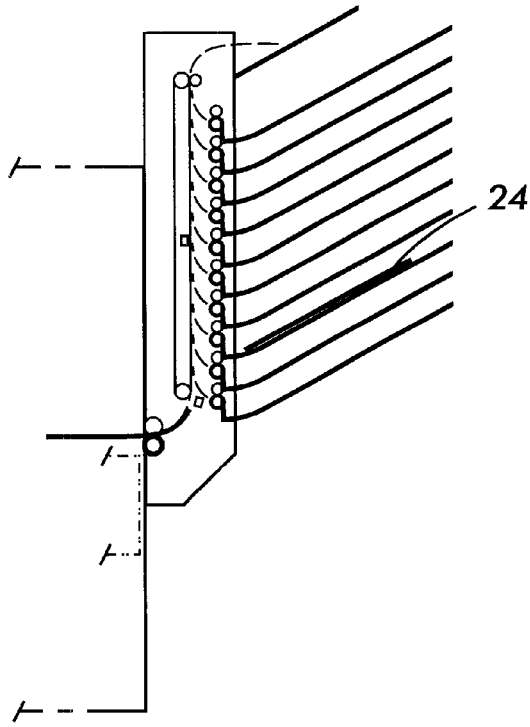

The system 8 generally functions by receiving a sheet 24 from the system 2 and transporting the sheet 24 along the path 28 towards a selected station 12. In an alternate embodiment, the sheet 24 could be received into the system 8 from any suitable document handling device. Generally, sheets 24 are received from an IOT device. The IOT generally comprises the print engine in a printer or copier. The IOT is generally the component of a multifunctional printer that produces the prints. The speed at which the sheets 24 pass through the IOT is generally called the process speed. In one embodiment, the system 8 can accelerate the sheet 24 out of the IOT 4 in order to pull a time gap as shown in FIG. 3A. Accelerating the sheet 24 to pull a gap generally means that after the sheet 24 leaves for example, a marking engine or after exiting the fuser in a photocopier or printer, the downstream nips exiting the IOT 4 or those in the finisher are accelerated to a speed greater than the process speed of the system 2. In one embodiment, the speed of the sheet transport device 20 could be accelerated to pull the time gap. This increases the physical gap and the time gap between the trail edge (TE) of one sheet and the lead edge (LE) of the next. The time gap gives extra time for finishing operations such as offsetting an output tray between sets, and stapling, etc. The acceleration can be done using independent drive motors for different portions of the path 28 and accelerating one or more of these drives, or it can be done by simply gearing the downstream nips to go faster and putting slip clutches into the upstream nips. Slip clutches are generally one-way clutches that provide forward drive force, but "freewheel" or "slip" if a sheet is pulled faster by a downstream nip. As soon as a sheet 24 reaches the faster downstream nip it will accelerate to the higher speed. Generally the time gap is of a sufficient duration so that sheet transport device 20 can deliver the sheet 24 into the designated station 12 and then reverse the direction of the sheet transport device to its original direction before the next sheet 25 reaches the sheet transport device 20 through the IOT 4. In this embodiment, as the sheet 24 travels along the path and passes a point in the path 28 adjacent to or just past a gate 16 corresponding to the desired destination station 12, the direction of the sheet transport device 20 is reversed as shown in FIG. 3B. When the direction of the sheet 24 is reversed, the sheet 24 is directed into the desired station 12 by the gate 16 as shown in FIG. 3C. This reversal action inverts the sheet 24 into a face down direction in the station 24 (assuming that the sheet 24 was delivered out of the IOT 4 in a face up orientation) and delivers the sheet 24 into the correct station 12. In one embodiment, the system 8 is generally adapted to be used with document marking and handling devices that mark sheets in a face up orientation, such as for example, low end printers, inkjet printers, or devices that use bottom transfer Xerography. The sheet transport device 20 then reverses direction again before the next sheet 24 reaches the sheet transport device 20 out of the IOT 4.

Figure 4A:
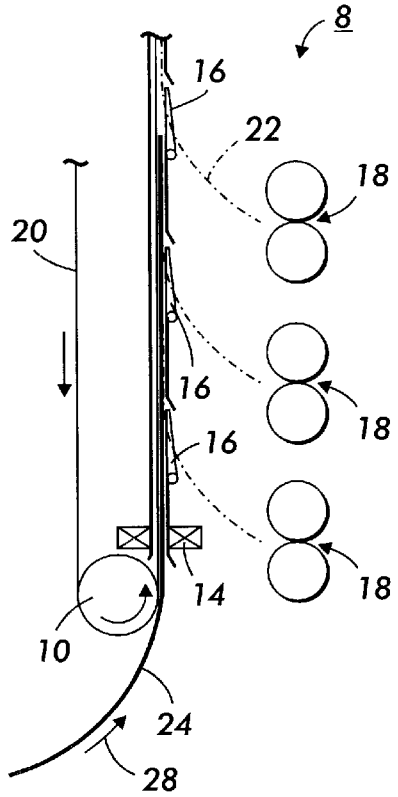
FIGS. 4A–4D are exploded perspective views of a portion of another embodiment of the present invention showing the movement of a sheet through the system.
Figure 4B:
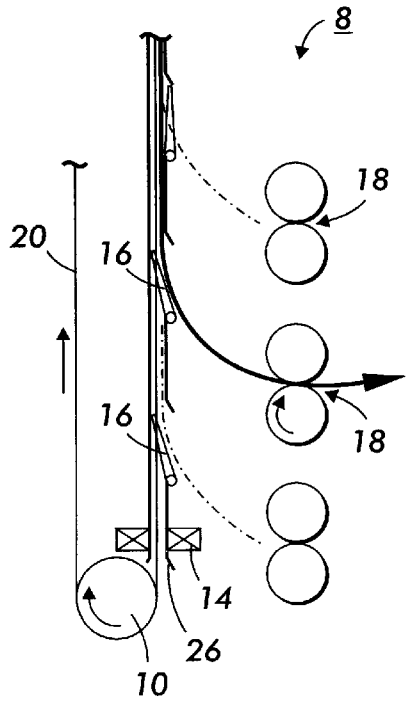
Figure 4C:
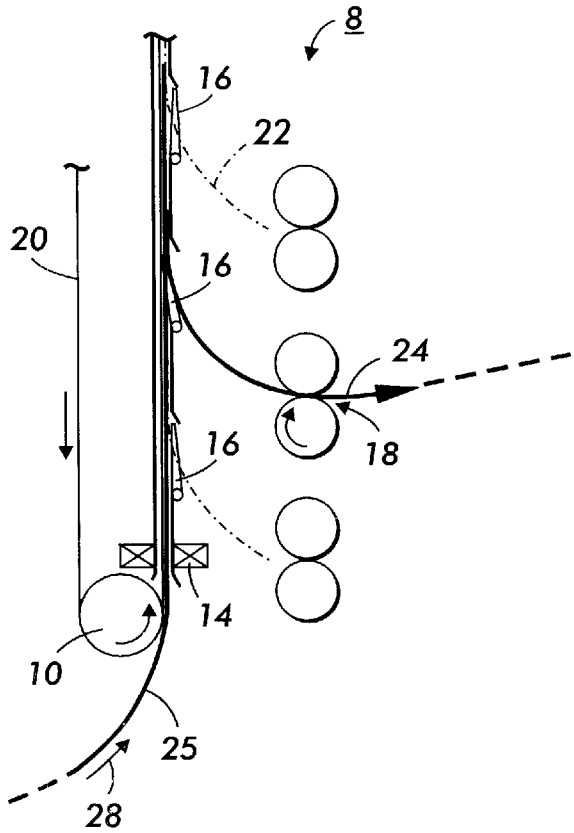
Figure 4D:
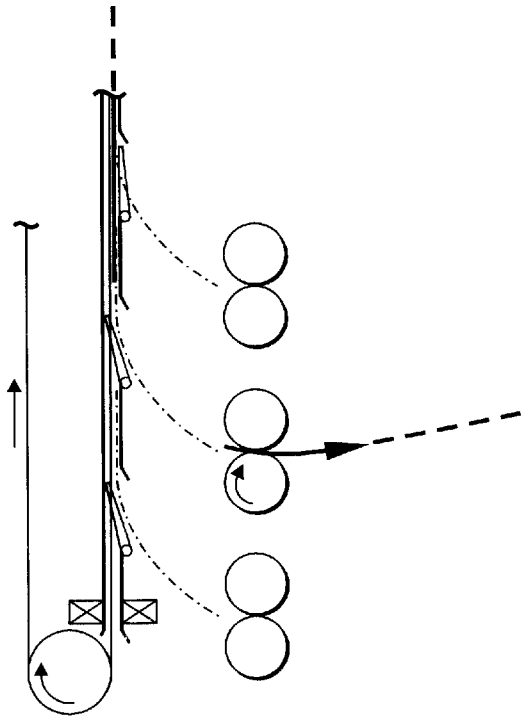

In one embodiment, the sheet transport device 20 can comprise a low drive force vertical drive apparatus, such as for example, magnetic skis on a belt. In this embodiment, overlapping of sheets 24 is permissible as long as the sheet 24 entering the station 12 does not block the subsequent sheet 25 in the path 28 from being directed by the proper gate 16. Generally, the drive force of the exit nip 18 exerted on the sheet 24 is adapted to overcome a drive force of the sheet transport device 20 exerted on the sheet 24. For example, as shown in FIG. 4A, a first sheet 24 enters the system 8. A sensor 14 detects a trailing edge of the sheet 24 as the sheet passes the sensor 14. In one embodiment, a set of magnetic skis, or soft nip rollers 26 can be used to load the media or sheet 24, against the sheet transport device 20. The detection of the trailing edge of the sheet 24 triggers the stop/reverse timing sequence of the drive apparatus 10. The timing sequence allows the sheet 24 to be moved along the path 28 for a predetermined period associated with the selected station 12. At the end of the time period, which generally corresponds to a position of the first sheet 24 at a point in the path 28 just past a gate 16 corresponding to a desired destination station 12, the direction of the sheet transport device 20 is reversed and the sheet 24 is driven into the exit nips 18 through the gate 16 as shown in FIG. 4B. Since the first sheet 24 is being pulled by a positive drive force of the exit nips 18, the sheet transport device 20 can again be reversed, driving the sheet transport device 20 forward and allowing a second sheet 25 to enter the drive apparatus 8 as shown in FIG. 4C. As the second sheet 25 is transported along the path 28, the first sheet 24 continues into the station 12 as shown in FIG. 4D. After the detection of the sheet 25 by the sensor 14 and an appropriate time delay, the sheet transport device 20 is again reversed in order to drive the sheet 25 through a gate 16 and into the desired station 12.

Figure 5:
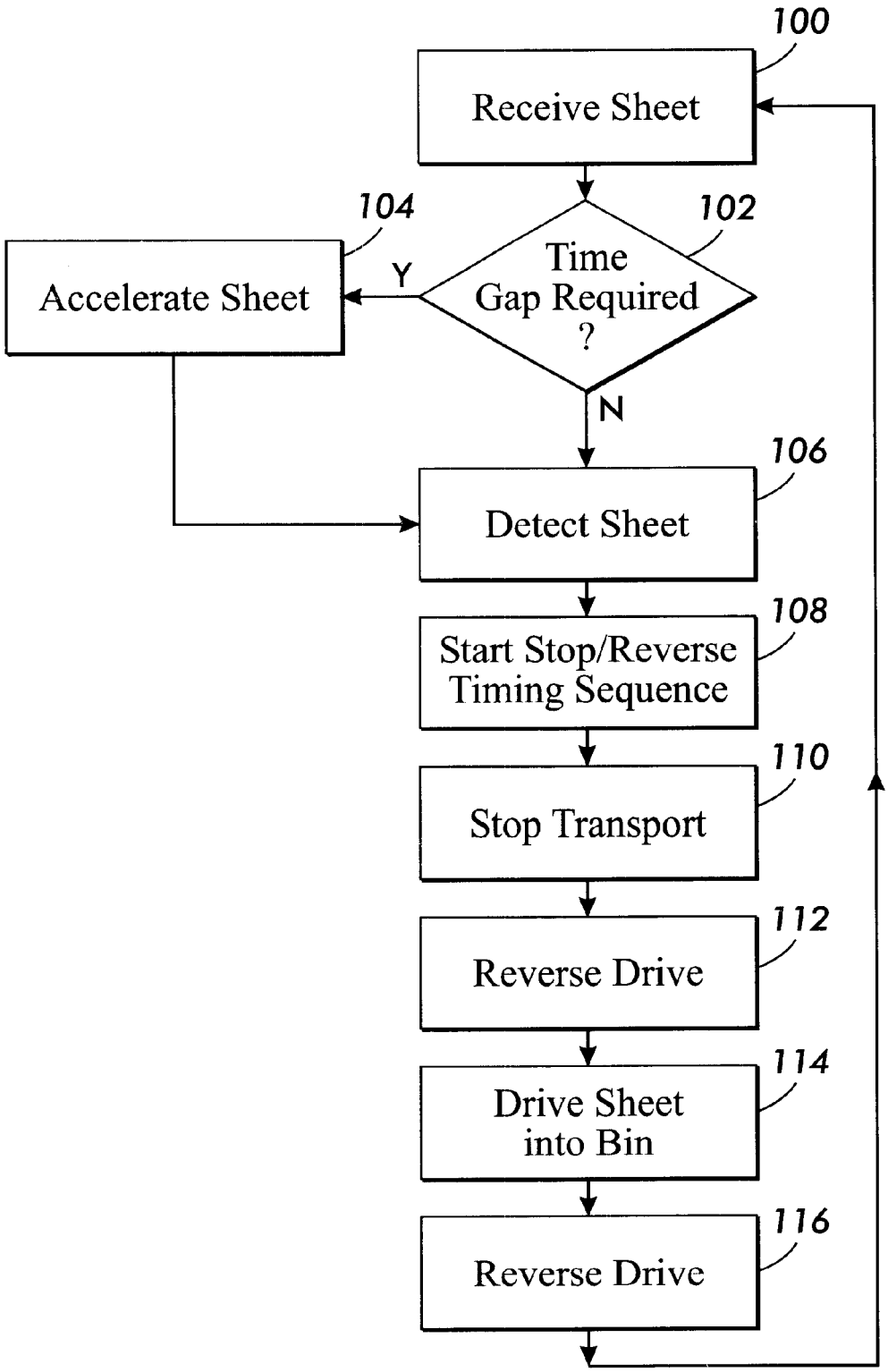
FIG. 5 is a flowchart for one embodiment of a method incorporating features of the present invention.

An embodiment of a method incorporating features of the present invention is shown in FIG. 5. Generally, the method comprises receiving 100 a sheet 24 into the drive apparatus 8. If a time gap is required 102, the method can include accelerating 104 the sheet 24 in order to pull a time gap. A sensor 14 detects 106 a trailing edge of the sheet 24 as it passes the sensor 14. After a predetermined time interval, the sheet transport device 20 is stopped 108 at a point in the path 28 adjacent or past a gate 16 corresponding to the desired destination station 12. The drive of the sheet transport system 20 is reversed 110. The gate 16 directs 112 the sheet 24 into the destination station 12. The direction of the sheet transport device 20 is again reversed 114 into a forward direction so that a new sheet 25 can be received onto the sheet transport device 20.

Figure 6:
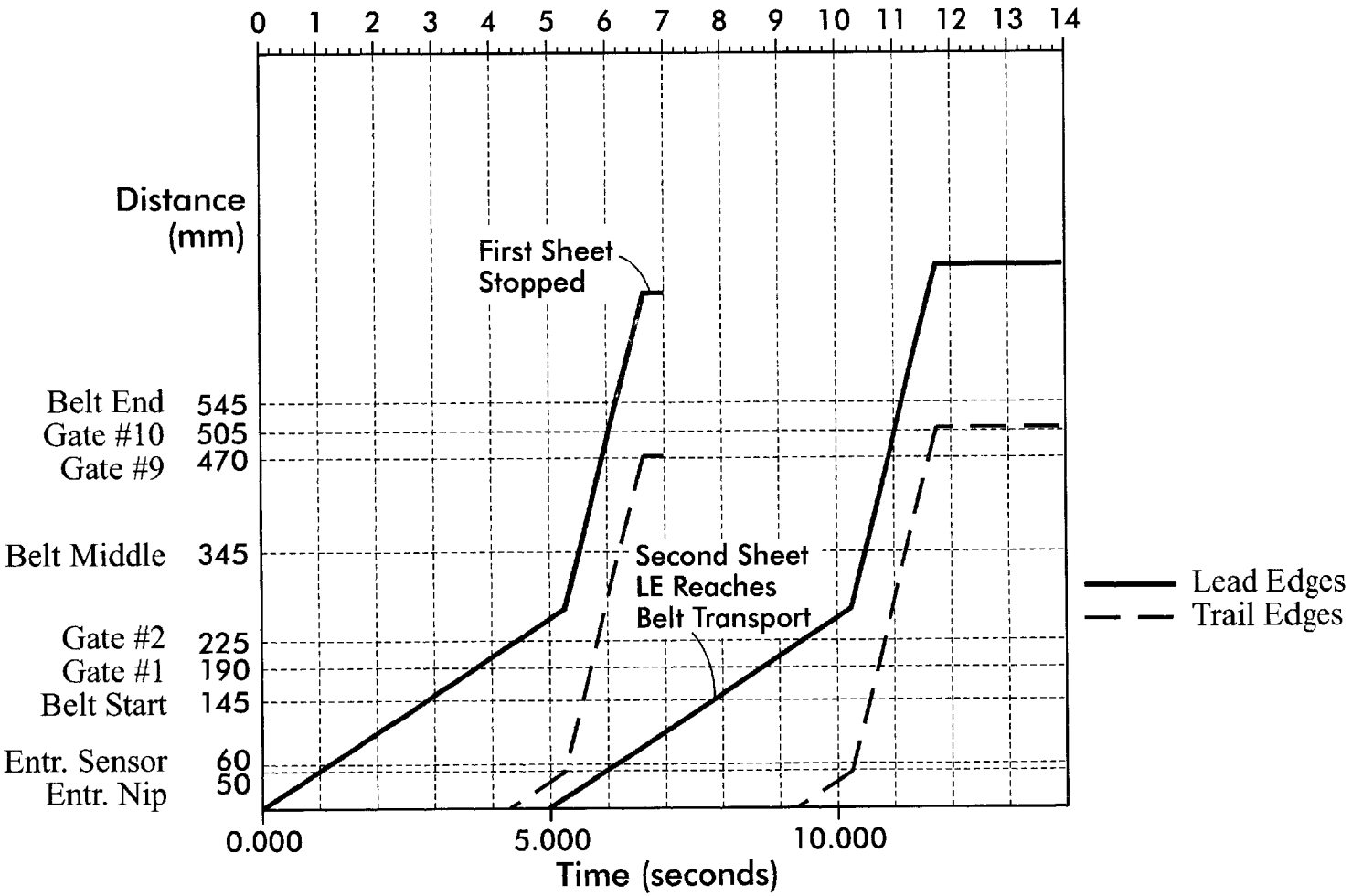
FIG. 6 is a timing diagram for a system incorporating features of the present invention.

A timing analysis modeling two sheets 24 and 25 being fed into adjacent stations 12 is shown in FIG. 6. As shown, if the sheets 24, 25 in a 12 page per minute ("ppm") processor are accelerated from a process speed of 50 mm/s to 300 mm/s when they enter the system 8, an extremely large gap is created. This gap would be large enough so that the sheet transport device 20 could drive a first 8½ by 11 inch sheet 24 into a station 12, and then reverse direction before the leading edge of the next sheet 25 reaches the sheet transport device 20. In this example, the use of a slip sheet is not necessary. The timing analysis in FIG. 6 also shows that speeds of 12 pages per minute are possible without slip. The delivery of 17-inch sheets may require pulling a larger gap, some sheet slip, or a slight decrease in productivity.

Figure 7A:
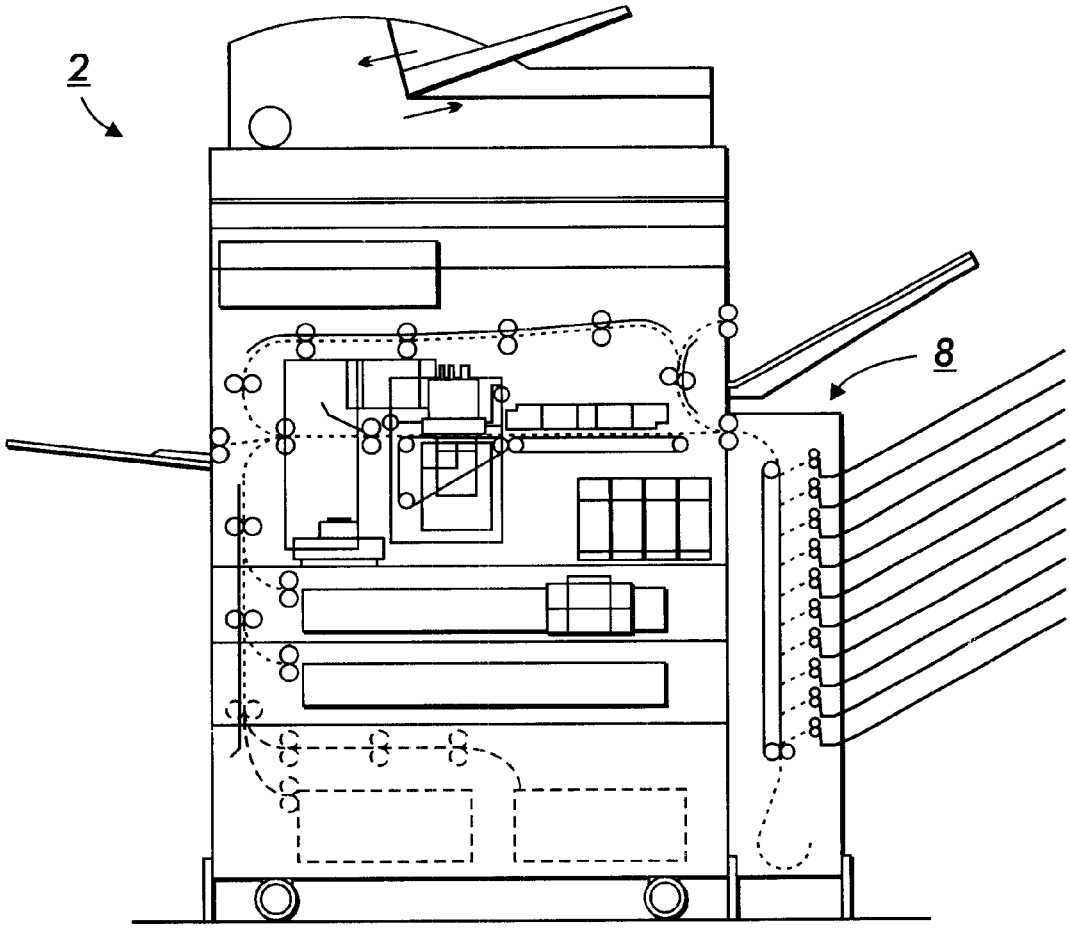
FIGS. 7A and 7B are views of different architectures than can be used to practice the present invention.
Figure 7B:
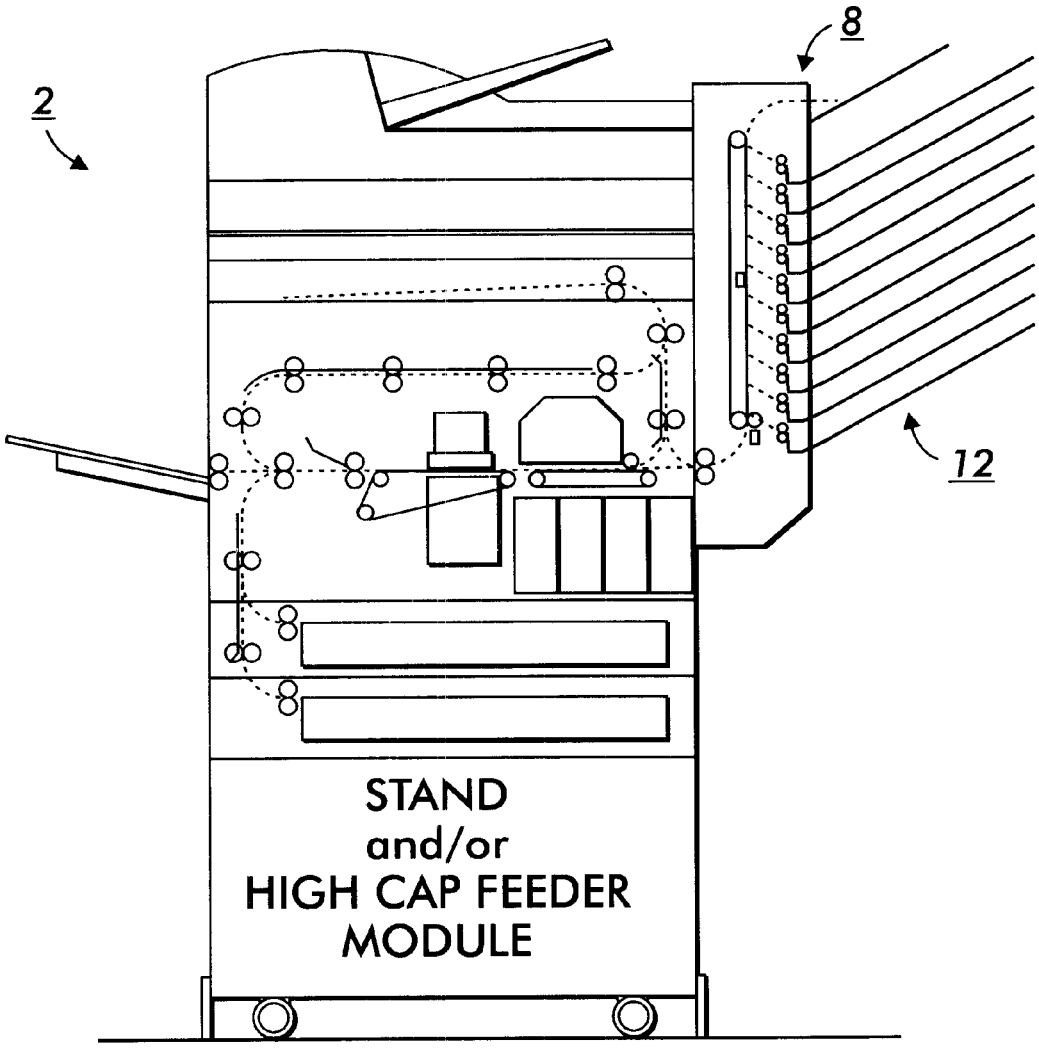

FIGS. 7A and 7B depict different embodiments of architectures that can be used to practice the present invention. FIG. 7A depicts a printer/copier system 2 with the sheet handling system 8 in a lower orientation. In this embodiment, the printer/copier system 2 delivers the sheets 24 to the system 8. In FIG. 7B, a similar printer or a copier 2 is shown with the sheet handling system 8 in an upper orientation. Other components of a multifunctional printer or document device can include an image-input terminal that can comprise for example, a document handler and scanner, a digital front end and a finisher. The finisher is generally the device that collects the output and performs other functions such as stapling.

By using the drive apparatus 10 to control the movement of a sheet 24 in the path 28, the system 8 allows sheets 24 to be directed into a specific destination station 12 without the need for active gates, movement of the stations, or movement/translation of the entrance nip. By eliminating gate solenoids, and separate station or nip moving systems, the system 8 can be produced at a relatively low cost. In one embodiment, the system 8 can be used with low speed printer Mailbox systems because the stations 12 remain stationary and provide good operability, and enabling the mounting of optional station "locking" doors if desired.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. A sheet handling transport apparatus comprising:

a sheet transport mechanism adapted to move at least one sheet in at least one direction along a paper path; and a plurality of sheet receiving stations in the apparatus, each station having a gate and an entrance nip, the transport mechanism being adapted to advance a selected sheet along the path to a point adjacent a gate of a selected receiving station, reverse direction and drive the selected sheet into the selected gate, wherein when a leading edge of the selected sheet engages a selected entrance nip, the transport mechanism is adapted to reverse direction and advance a next selected sheet along the path while the entrance nip drives the selected sheet into the selected receiving station.

2. The apparatus of claim 1 wherein the sheet transport mechanism is a reversible drive sheet transport device with variable stopping points.

3. The sheet handling transport apparatus of claim 1 wherein the apparatus is a sheet sorter output device.

4. The apparatus of claim 1 further including at least one sensor for detecting the sheet in the path, the sensor being further adapted to initiate a timing sequence for reversing the direction of the sheet in the path after a predetermined time period associated with the selected station.

5. The apparatus of claim 1 wherein each sheet receiving station is stationary.

6. The apparatus of claim 1 wherein the sheet transport mechanism is a belt drive system.

7. The apparatus of claim 1 wherein the entrance nip is stationary.

8. The apparatus of claim 1 wherein the entrance nip to each receiving station exerts a drive force on the selected sheet that is greater than a drive force exerted by the sheet transport mechanism on the selected sheet when the sheet transport mechanism reverses direction to advance the next selected sheet.

9. The apparatus of claim 1 wherein the gate is spring loaded in a direction toward the sheet transport mechanism.

10. A method of directing a sheet into a sheet receiving station of a transport apparatus comprising the steps of:

transporting the sheet in a first direction in a path of the apparatus;

reversing a drive of the transport apparatus when the sheet is at a point in the path adjacent a gate associated with the sheet receiving station;

driving the sheet in a second direction through the gate associated with the sheet receiving station and into an entrance nip of the sheet receiving station; and reversing the drive of the transport apparatus in order to simultaneously advance at least one other sheet in the path in the first direction while the sheet is transported into the sheet receiving station.

11. The method of claim 10 wherein the transport apparatus comprises a sheet sorter apparatus.

12. The method of claim 10 further comprising the step, prior to the step of transporting the sheet, of increasing a transport speed of the sheet to a speed greater than a process speed of the sheet in order to pull a time gap, wherein the time gap is adapted to provide a required time for the sheet to enter the sheet receiving station before another sheet is received into the apparatus.

13. The method of claim 10 wherein the step of driving the sheet further comprises the steps of:

driving a leading edge of the sheet into the entrance nip associated with the station; and reversing the drive of the transport apparatus to simultaneously drive the at least one other sheet in the path in the first direction, wherein a drive force exerted on the sheet by the entrance nip is adapted to overcome an opposing drive force exerted on the sheet by the transport apparatus.

14. The method of claim 10, further comprising the steps, after the step of transporting the sheet, of:

detecting the sheet in the path of the apparatus; and starting a stop/reverse time sequence adapted to initiate the stopping and reversal of the drive at a predetermined time after the sheet is detected, the predetermined time associated with the sheet receiving station.

15. A method of directing a sheet into one of a plurality of sheet receiving stations in a reversible drive transport apparatus, the method comprising the steps of:

detecting a presence of a sheet in a first transport path of the transport apparatus;

transporting the sheet in a first direction along the first transport path for a predetermined time period after detecting the presence of the sheet, the predetermined time period being associated with a position of selected sheet-receiving station;

reversing a direction of movement of the transport apparatus;

directing the sheet into a second transport path using a gate associated with the selected station, wherein the sheet is delivered into an entrance nip associated with the selected station; and simultaneously transporting another sheet detected in the first transport path in the first direction while the entrance nip drives the sheet into the selected station.

16. The method of claim 15 wherein the step of detecting a presence of the sheet comprises the step of using a sensor to detect a trailing edge of the sheet as it passes the sensor.

17. The method of claim 15 further comprising the step, after the step of transporting the sheet in a first direction, of stopping the sheet at the end of the predetermined time period, wherein the trailing edge of the sheet is located at a point adjacent to the gate associated with the selected station.

18. A method of directing a sheet into a bin of a sheet sorter apparatus comprising the steps of:

receiving the sheet into the sheet sorter apparatus;

determining if a time gap is required between the sheet and another sheet;

detecting the sheet moving in a first direction in a path of the apparatus;

initiating a sorter drive timing sequence, the timing sequence adapted to reverse a drive of the apparatus after a predetermined time associated with the bin;

reversing the drive of the sorter apparatus to drive the sheet through a gate and into an entrance nip associated with a desired sheet receiving station; and reversing the drive of the sorter apparatus to drive the another sheet in the first direction while the sheet is simultaneously transported into the desired receiving station.

19. The method of claim 18 further comprising the step, after the step of determining if a time gap is required, of increasing a transport speed of the sheet to a speed greater than a process speed of the sheet in order to pull the time gap.

20. The method of claim 15 wherein the step of simultaneously transporting another sheet detected in the first transport path further comprises the step of reversing the drive of the transport apparatus to drive the another sheet being transported in the apparatus in the first direction, wherein a drive force exerted on the sheet by the entrance nip is adapted to overcome a drive force exerted on the sheet by the transport apparatus.

21. The method of claim 18 wherein the step of reversing the drive of the sorter apparatus to drive the another sheet in the first direction further comprises the step of causing the entrance nip to exert a drive force on the sheet sufficient to overcome a drive force exerted on the sheet by the sorter apparatus.

22. The sheet handling apparatus of claim 1 wherein the transport mechanism is adapted to simultaneously advance the next selected sheet along the path while the selected entrance nip drives the selected sheet into the selected receiving station.

23. A sheet sorter system comprising:

a sheet transporter adapted to move at least one sheet in a paper path in at least one direction;

at least one sheet receiving station along the paper path, the sheet receiving station having an associated gate and entrance nip along a sheet receiving path; and a controller adapted to cause the transporter to advance a first sheet in the paper path to a predetermined point in the path, reverse a direction of movement of the sheet transporter to drive the first sheet into a selected gate and entrance nip, and change the direction of movement of the sheet transporter to advance a second sheet in the paper path while the selected entrance nip drives the first sheet into a selected sheet receiving station.

24. The sheet sorter system of claim 23 wherein the entrance nips are adapted to exert a greater drive force on a sheet than the transporter exerts on the same sheet.

25. The sheet sorter system of claim 23 wherein the transporter is a vertical transport system.

* * * * *